United States Patent [19]

Thomas

[11] 4,046,538

[45] Sept. 6, 1977

[54] OSCILLATING MECHANISM AND METHOD OF AND MEANS FOR PROMOTING MOTION ACCURACY OF THE MECHANISM IN A FIBER FORMING OPERATION

[75] Inventor: David Whitfield Thomas, Granville, Ohio

[73] Assignee: Owens-Corning Fiberglas Corporation, Toledo, Ohio

[21] Appl. No.: 678,505

[22] Filed: Apr. 19, 1976

[51] Int. Cl.[2] ..... C03B 37/02

[52] U.S. Cl. ..... 65/4 A; 65/9; 74/512; 74/513; 156/62.4; 226/168; 264/112; 425/6; 74/512;513

[58] Field of Search ..... 65/4 A, 2, 9, 11 R; 156/62.4; 226/168; 264/112; 425/6; 19/155

[56] References Cited

U.S. PATENT DOCUMENTS

| | | | |
|---|---|---|---|
| 2,111,686 | 3/1938 | Warren | 74/513 X |
| 2,166,866 | 7/1939 | Hansen | 74/513 X |
| 2,873,820 | 2/1959 | Rizzuto | 74/512 X |
| 3,295,942 | 1/1967 | Smock et al. | 65/9 X |

*Primary Examiner*—Robert L. Lindsay, Jr.
*Attorney, Agent, or Firm*—John W. Overman; Ronald C. Hudgens; Kenneth H. Wetmore

[57] ABSTRACT

The disclosure embraces a method of and apparatus for distributing linear groups of fibers onto a moving collector which include engaging and advancing groups of fibers by rotating pull wheels, disengaging the groups of fibers from the pull wheels by oscillating and rotating members associated with the pull wheels, oscillating the members by cam-actuated systems of linkage to control disengagement of the groups of fibers from the pull wheels and effect distribution of the groups of fibers on the collector, and applying pressure on the linkage systems opposing the operation of the systems to substantially eliminate lost motion in the linkage systems and thereby promote oscillatory motion accuracy of the fiber disengaging members whereby the collected body of fibers is endowed with substantially uniform characteristics.

7 Claims, 4 Drawing Figures

OSCILLATING MECHANISM AND METHOD OF AND MEANS FOR PROMOTING MOTION ACCURACY OF THE MECHANISM IN A FIBER FORMING OPERATION

This invention relates to an oscillating mechanism or system in association with material processing units of a character usable in the formation of fibrous masses or products wherein successively arranged units deliver fibrous or filamentary materials onto a moving collector to produce an assemblage or product, the oscillating mechanism or system being adapted to eliminate adverse effects of tolerances in the motion accuracy of the mechanism in exercising control of the material processing units to maintain substantially uniform the size and character of the composite assemblage or end product comprising the collected material.

In the manufacture of fibrous or filamentary products, such as fibrous mats, it is a practice to utilize several fiber or filament forming and processing stations or units arranged to continuously deposit attenuated filaments or fibers on a moving conveyor or collector to form a built up fibrous mass or mat. In such processes wherein continuous filaments or fibers of glass are utilized in producing mats, streams of heat-softened glass flowing from stream feeders are attenuated to continuous filaments through the use of rotating pull wheels wherein the pull wheels are provided with oscillating means for delivering or projecting strands of the filaments from the pull wheels in parallel and planar formation back and forth transversely of or across a lengthwise moving conveyor or collector to form a mat.

The oscillating means associated with the pull wheels are operated so that the strands are collected to provide a mat of substantially uniform width. An apparatus of this character for forming a mat of continuous filaments of glass is disclosed in the Langlois and Stream U.S. Pat. No. 3,265,482.

Certain difficulties have been encountered in the formation of mats of this character in that the pivoted connections or joints of the linkage mechanism for actuating the oscillating fiber or filament distributing or projecting mechanism required tolerances at the joints or pivotal connections for their operation and hence the accumulation of the operating tolerances often results in substantial variations in the points or zones of projection or delivery of the strands of filaments from the pull wheels resulting in irregularities in the edge regions of the mat or mass of fibers or filaments on the collector or conveyor. Furthermore, wear at the joints or connections tends to increase irregularities in the deposition of the strands of filaments on the collector.

The invention embraces a method of establishing a substantially constant force applied to the oscillating mechanism opposing the operation of the oscillating mechanism, the force being sufficient to overcome the inertial forces exerted by the interconnected members and linkage of the oscillating mechanism and promote motion accuracy of the mechanism.

An object of the invention resides in a method of establishing a substantially constant force on the linkage and members of an oscillating mechanism or system effective to hold the joints or pivotal connections in the same relative position throughout the range of travel of the mechanism or system in order to assure maintenance of motion accuracy of the mechanism or system.

Another object of the invention resides in a method of applying and maintaining a force effective on the joints or pivotal connections of an oscillating system or mechanism to substantially eliminate lost motion at the joints or pivotal connections to promote successive uniform movements of components of the oscillating mechanism.

Another object of the invention embraces an oscillating mechanism in combination with a fiber distributing apparatus and involves a method of and means for eliminating the effects of wear, lost motion or operating tolerances at the pivotal connections or joints of linkage and members of the mechanism controlling a fiber or filament distributing means to promote uniformity of distribution of the fibers or filaments on a collector.

Another object of the invention is the provision of an oscillating system or mechanism embodying two or more units or sets of interconnected linkage and members for effecting control of the distribution of two or more groups of fibers or filaments on a fiber or filament collecting area wherein each unit or set of linkage and members moves as a mirror image or near mirror image of another unit or set and wherein a constant force is exerted on each of the units or sets of linkage and members to hold the joints or pivotal connections in the same relative position whereby the fibers or filaments are distributed uniformly transversely of a fiber or filament collecting instrumentality.

Another object of the invention resides in an apparatus for forming and collecting fibers, such as continuous filaments of glass in combination with an oscillating mechanism for effecting and controlling distribution of the filaments at a collecting zone wherein fluid pressure is applied to the oscillating mechanism to eliminate lost motion at the joints of members and linkage of the oscillating mechanism to assure motion accuracy of the oscillating mechanism and hence promote uniformity of distribution of the filaments at the collection zone.

Another object of the invention resides in an apparatus for forming continuous filaments of glass at several filament forming stations wherein each station includes two filament attenuating instrumentalities in association with means for continuously varying the region of projection of the filaments from the attenuating instrumentalities to distribute the filaments transversely onto a moving conveyor, the apparatus including an oscillating mechanism for each set of fiber forming instrumentalities wherein fluid pressure is applied to connected components of the oscillating mechanisms for preloading the pivotal connections or joints of each oscillating mechanism to eliminate the adverse effects of operating tolerances or lost motion at the joints or pivotal connections to assure motion accuracy of each of the oscillating mechanisms and promote uniform distribution of the filaments from the attenuating instrumentalities.

Further objects and advantages are within the scope of this invention such as relate to the arrangement, operation and function of the related elements of the structure, to various details of construction and to combinations of parts, elements per se, and to economies of manufacture and numerous other features as will be apparent from a consideration of the specification and drawing of a form of the invention, which may be preferred, in which.

Figure 1:
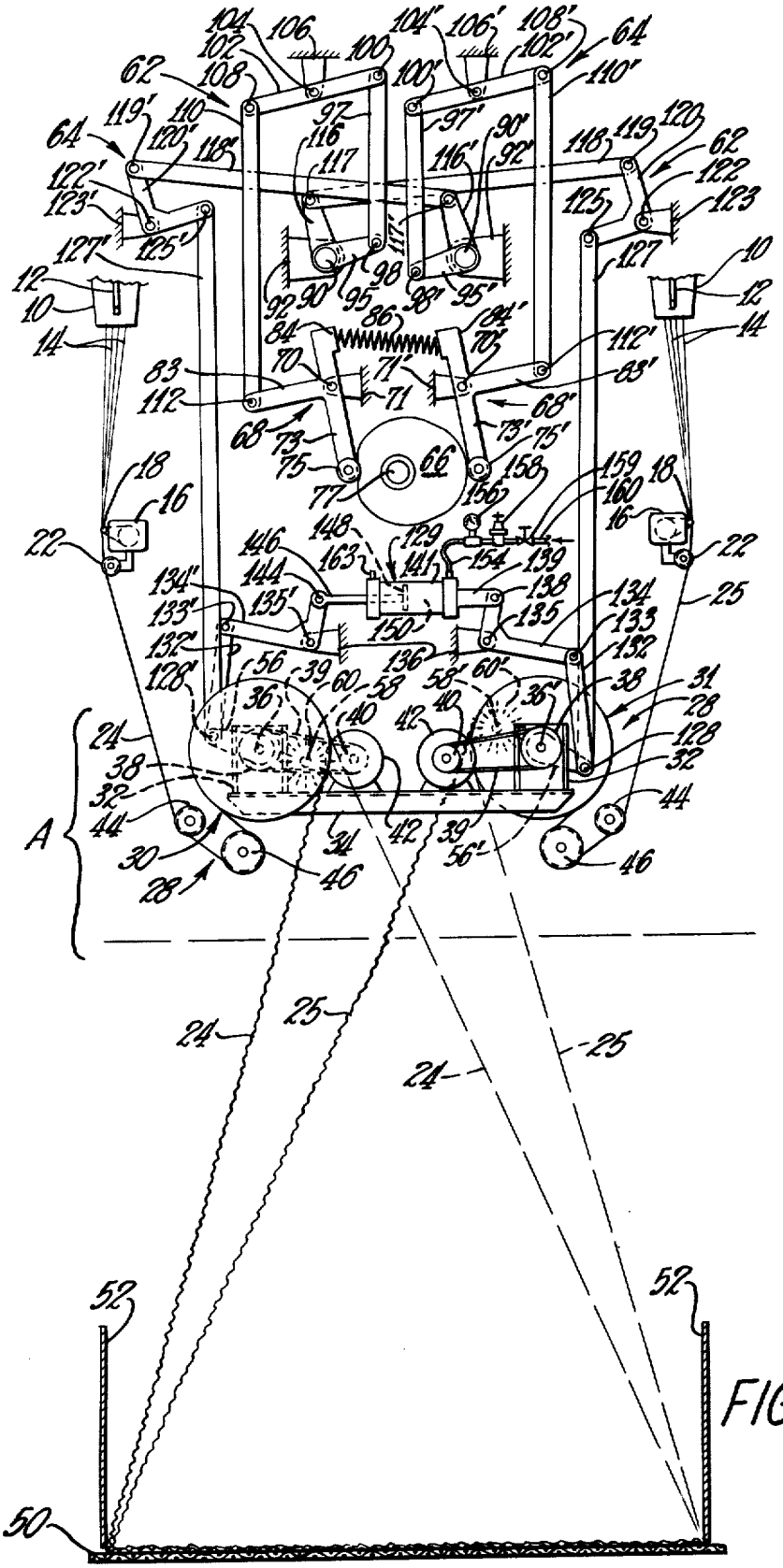
FIG. 1 is a front elevational view of a fiber forming and distributing apparatus embodying the invention.

While the invention is illustrated as embodied in an oscillating system or mechanism of an apparatus for attenuating heat-softened material, such as glass, to fibers or continuous filaments distributed onto a moving conveyor or collector, it is to be understood that the invention may be utilized with oscillating apparatus or systems for processing other materials.

In the arrangement illustrated in the drawings, the attenuating apparatus is particularly usable for attenuating streams of heat-softened glass to continuous fibers or filaments converged into groups or strands and the groups or strands from several attenuating units distributed onto a moving conveyor to form a collected mass or mat of the continuous filaments.

Referring to the drawings in detail and initially to FIG. 1, there is illustrated an apparatus for attenuating streams of glass into continuous fibers or filaments which are converged into groups of strands and the strands collected to form a fibrous mat or mass. Several stream feeders 10, two of which are shown in FIG. 1, are arranged in two spaced parallel rows each adapted to contain heat-softened fiber forming material such as glass.

The feeders 10 may be directly connected with a forehearth of a glass melting furnace to receive molten glass therefrom, or pieces of glass may be delivered into the feeders and melted therein. Each of the feeders 10 is equipped at its ends with terminals 12 connected with an electric current supply for maintaining the softened glass in the feeders at a proper temperature and viscosity for attenuation. Each of the stream feeders has a floor section provided with orifices through which flow streams of glass adapted to be attenuated to continuous fibers or filaments 14.

It is desirable to apply a liquid, such as water, size or binder, onto the filaments. For this purpose a receptacle 16 is provided beneath each feeder for treating the filaments attenuated from glass streams from a feeder. Each receptacle is equipped with a belt-like applicator 18 which moves through the liquid in the receptacle acquiring a film of the liquid which is transferred to the filaments by wiping contact in a conventional manner.

Figure 2:
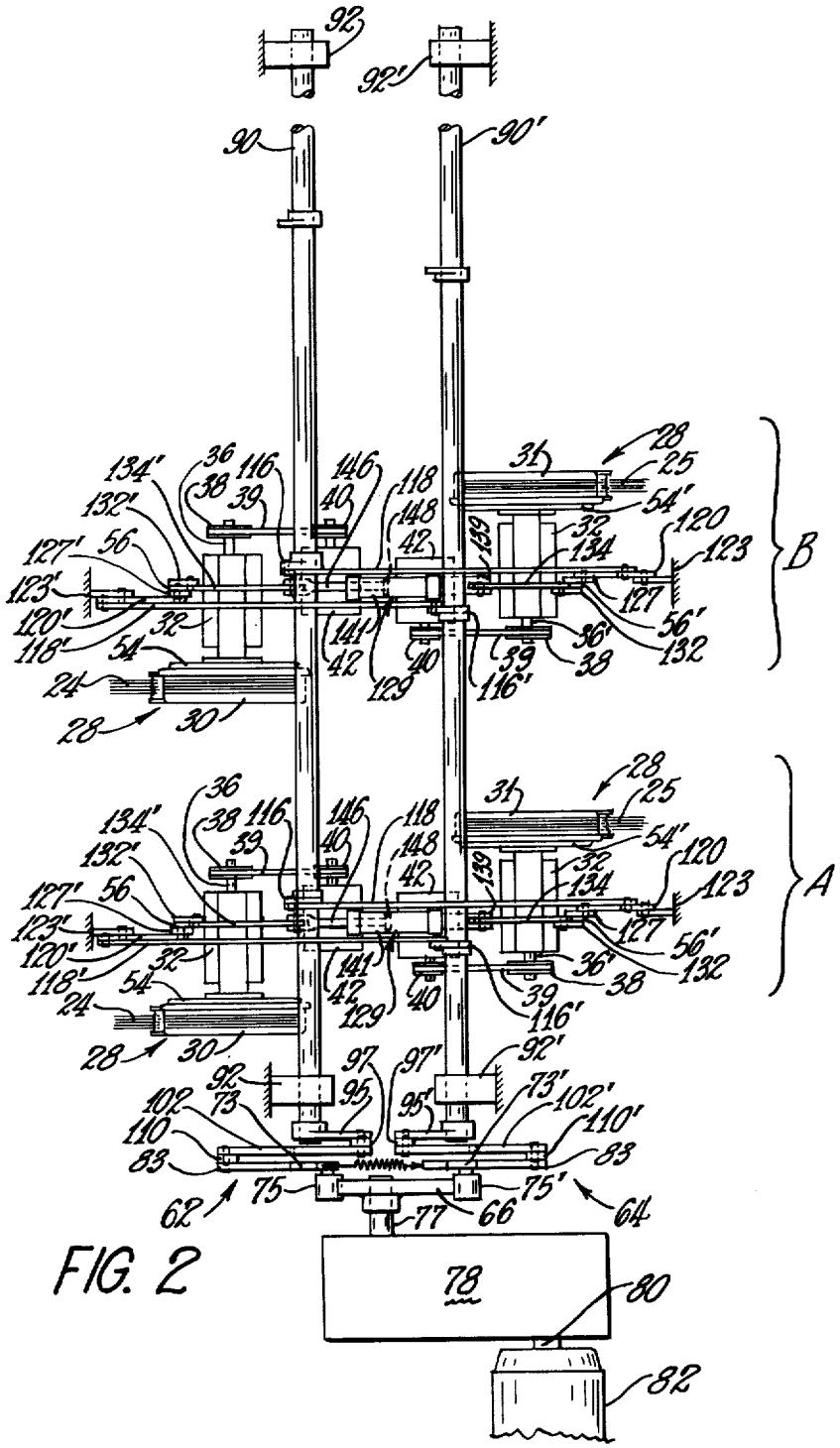
FIG. 2 is a plan view of a portion of the apparatus of FIG. 1 illustrating two sets of fiber attenuating units and oscillating mechanisms embodying the invention.

Disposed beneath each of the receptacles 16 is a gathering shoe 22 provided with a plurality of grooves for segregating the filaments attenuated from streams of glass flowing from a bushing or feeder into sets or groups of strands 24 and 25, there being five strands in each group as shown in FIG. 2. It is to be understood that the number of strands of filaments is determined by the number of segregating grooves in the gathering shoes.

In order to deposit a substantial amount of continuous fibers or filaments to form a mass or mat on the conveyor, several fiber-forming stations are provided. FIG. 1 is a view of one fiber-forming station A, FIG. 2 illustrating two of the fiber-forming stations A and B which are arranged lengthwise of the fiber-collecting conveyor. The arrangements of components comprising stations A and B are substantially identical. Each of the fiber-forming stations is inclusive of two stream feeders 10, the streams of glass attenuated into filaments providing the strand groups 24 and 25.

Each of the stations A and B includes two attenuating units 28, there being a filament attenuating and distributing unit 28 provided for each of the stream feeders 10 for attenuating the glass streams to continuous filaments by mechanical means. Each of the attenuating units 28 at each of the stations A and B, as shown in FIG. 2, includes rotatable strand-engaging means or pull wheels 30 and 31 journaled upon supports 32 mounted upon a frame construction 34, the latter being shown in FIG. 1. Each pull wheel is supported on a shaft 36 mounting a sprocket 38 driven by a belt 39 from a sprocket 40 mounted on a shaft of an electrically energizable motor 42.

The groups of strands 24 and 25 engage rolls 44 which are provided with grooves aligned with the grooves in the gathering shoes 22. From the aligning rolls 44 the groups of strands 24 and 25 pass around idler rolls or wheels 46 and engage and travel around the pull wheels 30 and 31. The pull wheels 30 and 31 for the respective groups of strands 24 and 25 are of similar construction but are relatively reversed in position as shown in FIG. 2 and are on opposite sides of a vertical plane through the longitudinal center of a filament receiving conveyor or collector 50.

The conveyor 50 is of the endless belt type which is continuously moved lengthwise in a conventional manner by motive means (not shown). The fiber or filament receiving area of the conveyor may be defined laterally by side shields or walls 52. As shown in FIG. 1, the group of strands 24 is delivered or projected in a tangential path from the pull wheel 30 for transverse distribution on the conveyor 50. The group of strands 25 is delivered or projected in a tangential path from the pull wheel 31 for transverse distribution on the conveyor 50.

Each of the attenuating or pull wheel units 28 embodies an arrangement for disengaging or projecting the group of strands from a pull wheel at varying peripheral regions of the wheel to effect transverse or lateral distribution of each group of strands over the width of the collector or conveyor 50. The arrangement for delivering or projecting the strands from a pull wheel is of the character shown in Langlois and Stream U.S. Pat. No. 3,265,482.

Journally supported by means associated with the shaft 36 mounting the pull wheel 30 is a disc-like member or backing plate 54, an arm or member 56 being fixedly connected with the backing plate or member 54. The adjacent pull wheel 31 journaled on a shaft 36' is associated with a backing plate or disc-like manner 54' to which is fixedly connected an arm or member 56'. Journally supported upon a stub shaft 58 carried by the disc or plate 54 is a spoke wheel 60, the spokes or fingers of the wheel projecting through slots in the peripheral surface of the pull wheel 30.

The spoke wheel 60 is rotated by a toothed belt (not shown) connected with a sprocket on the adjacent shaft 36 whereby the spoke wheel is rotated in timed relation with the rotation of the adjacent pull wheel 30 whereby the fingers or spokes of the wheel move into the slots to release or project the strands from the pull wheel 30.

Journally supported by means associated with the shaft 36 mounting the pull wheel 31 is a disc-like member or backing plate 54' arranged to be oscillated, a member or arm 56' being fixedly connected with the plate or member 54'. Journally supported upon a stub shaft 58' carried by the backing plate 54' is a spoke wheel 60', the spokes or fingers of the wheel 60' projecting through slots in the peripheral surface of the pull wheel 31.

The spoke wheel 60' is rotated by a toothed belt (not shown) connected with a sprocket on the adjacent shaft 36' mounting the pull wheel 31 whereby the spoke wheel is rotated in timed relation with the rotation of the pull wheel 31 whereby the fingers or spokes of the wheel 60' move into the slots to release or project the strands from the pull wheel 31.

The purpose of the projection of the spokes of each of the spoke wheels 60 and 60' outwardly of the peripheral surfaces of the pull wheels 30 and 31 is to release the groups of strands 24 and 25 from the peripheries of the pull wheels so as to project and distribute the strands by their inertia of motion transversely onto the conveyor 50.

An oscillating system or mechanism 62 comprising interconnected or interjoined linkage and members actuates or oscillates the backing plate or disc 54 to continuously oscillate or change the relative position of the spoke wheel 60 to distribute the group of strands 24 transversely of the conveyor 50. An oscillating system 64 which is substantially the same or a mirror image of the oscillating system 62 comprising interconnected or interjoined linkage and members actuates or oscillates the backing plate or disc 54' to continuously oscillate or change the position of the spoke wheel 60' to distribute the group of strands 25 transversely of the conveyor 50.

In the embodiment illustrated a means or actuator is provided for actuating or oscillating both oscillating systems or mechanisms. The actuator or instrumentality for actuating or oscillating the systems or mechanisms 62 and 64 comprises a cam 66 of generally heart-shaped configuration imparting a substantially uniform motion to a cam follower or followers.

Figure 3:
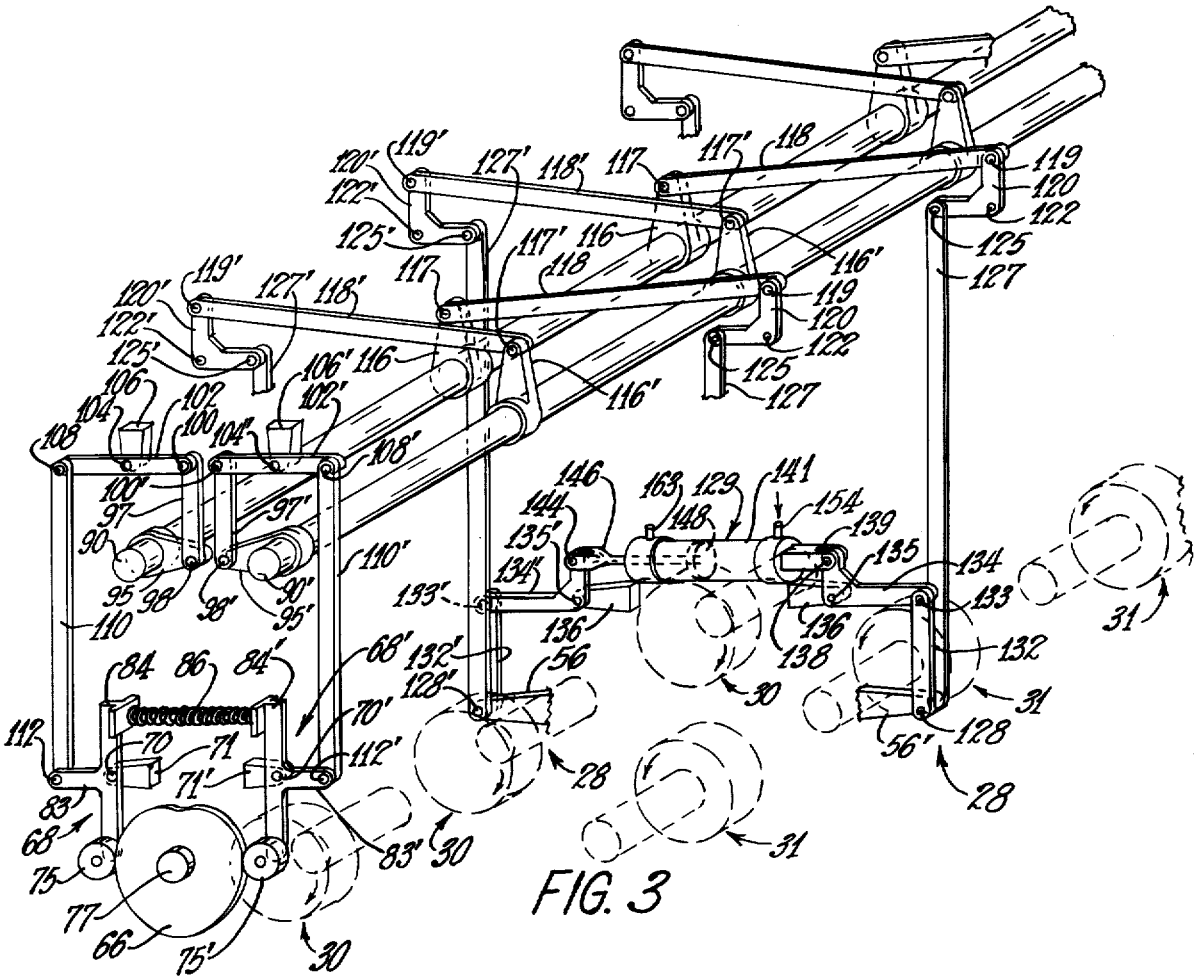
FIG. 3 is a fragmentary isometric view illustrating schematically the arrangement of linkage and elements of the oscillating system or mechanism and force applying means associated therewith.

The oscillating system or mechanism 62 comprises a member 68 which is pivotally mounted by a pin or stub shaft 70 on a stationary frame member 71. One arm 73 of the member 68 is equipped with a rotatably mounted cam follower or roller 75, the roller engaging the periphery of the cam or actuator 66 as shown in FIGS. 1, 2 and 3. The oscillating system 64 includes a member 68' pivotally mounted by a pin or stub shaft 70' on the frame member 71'. An arm 73' is equipped with a rotatably mounted cam follower or roller 75' which engages the periphery of the actuator or cam 66 substantially diametrically opposite the region of engagement of the cam follower 75 with the cam 66.

As particularly shown in FIG. 2, the cam or actuator 66 is mounted upon a shaft 77 which extends into a housing 78, the latter containing conventional speed reducing gearing or mechanism. A drive shaft 80 for the speed reducing mechanism extends into the housing 78, the speed reducing mechanism being driven by a motor 82 connected with the shaft 80. The speed reducing mechanism rotates the cam or actuator 66 at a speed providing a rate at which it is desired to distribute the groups of strands transversely onto the conveyor 50.

The member 68 has an upwardly extending portion 84 and the member 68' has an upwardly extending portion 84'. Disposed between the portions 84 and 84' is an expansive spring 86 which is under sufficient compression to hold the cam followers or rollers 75 and 75' in contact with the peripheral surface of the cam 66. Rotation of the cam 66 effects successive oscillations of each of the members 68 and 68'.

The oscillating systems or mechanisms 62 and 64 are effective to transfer motion of the members 68 and 68' to the arms 56 and 56' for oscillating the spoke wheels 60 and 60'. As particularly shown in FIGS. 1 and 2, the oscillating mechanism 62 is inclusive of a horizontally disposed shaft or member 90, and the oscillating mechanism 64 is inclusive of a similar shaft or member 90'. The shafts or members 90 and 90' are in parallel relation and are parallel to the axes of rotation of the several filament attenuating or pull wheels of the attenuating units.

The shaft 90 is journalled for rotation or oscillation in bearing members 92 supported by a suitable frame structure, and the shaft 90' is journaled for rotation or osciallation in bearing members 92' supported by the frame structure. The oscillating system or mechanism 62 includes an arm or member 95 secured to one end of the shaft 90. A link 97 is pivotally connected to arm 95 by a pivot pin 98. The other end of link 97 is pivotally connected by a pivot pin 100 with one end of a member 102 which is pivoted intermediate its ends on a pivot pin 104 mounted by a stationary support or frame structure 106.

The opposite end of the member 102 is pivotally connected by a pivot pin 108 to one end of a vertically disposed link 110. The lower end of the link 110 is pivotally connected by a pin 112 to an arm portion 83 of the member 68. Secured on the shaft 90 are lengthwise spaced arms or member 116, there being an arm for each of the attenuating stations A and B. Each of the arms 116 is connected by a pivot pin 117 with a generally horizontally disposed link 118, the opposite end of each of the links 118 being connected by a pin 119 with one arm of an L-shaped lever member or bell crank 120.

The bell crank 120 is pivoted by a pin 122 on a fixed support 123, the other arm of the bell crank 120 being pivotally connected by a pivot pin 125 with a substantially vertical link 127. The lower end of link 127 is pivotally connected by a pivot pin 128 with arm or member 56'. The above-described oscillating system or mechanism 62 which comprises members and linkages transfers motion of the cam follower 75 under the influence of the rotating cam 66 to the arm 56', the latter oscillating the spoke wheel 60', associated with the pull wheel 31, for discharging the group of strands 25 from the pull wheel and distributing the strands transversely over the area of the conveyor 50.

The oscillating system or mechanism 64 is a mirror image or near mirror image of the oscillating system 62. As shown in FIGS. 1, 2 and 3, the oscillating system or mechanism 64 includes an arm or member 95' secured to one end of the shaft 90'. A link 97' is pivotally connected to arm 95' by a pivot pin 98'. The other end of link 97' is pivotally connected by a pivot pin 100' with one end of a member 102' which is pivoted intermediate its ends on a pivot pin 104' mounted by a stationary support 106'. The opposite end of the member 102' is pivotally connected by a pivot pin 108' to one end of a vertically disposed link 110'.

The lower end of the link 110' is pivoted by a pin 112' to an arm portion 83' of the member 68'. Secured on the shaft 90' are lengthwise spaced arms or members 116', there being an arm for each of the attenuating stations A and B. Each of the arms 116' is connected by a pivot pin 117' with a generally horizontally disposed link 118', the opposite end of each of the links 118' being pivotally connected by a pin 119' with one arm of an L-shaped member, bell crank or lever member 120'.

The bell crank 120' is pivoted by a pin 122' on a fixed support 123', the other arm of the lever member 120' being pivotally connected by a pivot pin 125' with a substantially vertical link 127'. The lower end of line 127' is connected by a pivot pin 128' with the arm or member 56. The above-described oscillating system or mechanism 64 which comprises members and linkage transfers motion of the cam follower 75' under the influence of the rotating cam 66 to the arm 56, the latter oscilatting the spoke wheel 60 associated with the pull wheel 30 for discharging the group of strands 24 from the pull wheel 30 and distributing the strands transversely over the area of the conveyor 50.

The several pivotal or articulate connections or joints associated with the links and members of each of the oscillating systems or mechanisms 62 and 64 necessarily require tolerances or operating clearances forthe transmission of motion from the cam 66 to the arms 56 and 56' which effect oscillating movement of the spoke wheels 60 and 60'. The positions of the spoke wheels 60 and 60' relative to the adjacent pull wheels 30 and 31 determine the regions on the peripheries of the pull wheels from which the groups of strands 24 and 25 are projected onto and distributed transversely of the conveyor 50.

The operating clearances or tolerances at the several. pivotal connections or joints of the oscillating systems or mechanisms normally impair the transmission of motion accuracy of the cam-operated members 68 and 68' to the spoke wheel oscillating arms 56' and 56. The accumulated tolerances or operating clearances in the oscillating systems or mechanisms tend to result in improper or nonuniform delivery or projection of the strands 24 and 25 onto the conveyor. Such nonuniform delivery or projection of the strands varies the zones of deposition of the groups of strands particularly resulting in irregular edge regions of the collected mat or mass of nonuniform thickness.

The invention involves a method of and apparatus or means for exerting a substantially constant force opposing the operation of the oscillating systems or mechanisms to substantially eliminate the adverse effect of the tolerances and operating clearances of the pivotal connections or joints as the exerted constant force holds the pivotal joints or connections in substantially the same relative position throughout the systems or mechanism range of travel or movements whereby the transmission of motion accuracy to the strand projecting mechanism is assured.

One method and means for exerting force on the oscillating systems or mechanisms is illustrated at 129 in FIGS. 1, 2 and 3. In the embodiment illustrated a force exerting means is provided for the oscillating mechanisms or systems controlling the spoke wheel associated with each pair of pull wheels 30 and 31. Fluid pressure is preferably utilized as the force exerted against the linkage, members and pivotal connections of the oscillating systems or mechanisms.

Pivoted on the pin 128 is an upwardly extending link 132 which is pivotally connected by a pivot pin 133 to one arm of an L-shaped lever member or bell crank 134 pivoted or fulcrumed by a pin 135 on a stationary support 136. The other arm of the lever member 134 is pivotally connected by a pivot pin 138 to a projection 139 forming a part of the housing of a cylinder 141.

Pivoted on the pin 128' is an upwardly extending link 132' which is pivotally connected by a pivot pin 133' with one arm of an L-shaped lever member or bell crank 134'. The other arm of the lever member 134' is connected by a pin 144 with a piston rod 146 connected with a piston 148 reciprocable in the cylinder 141. Fluid under controlled pressure, such as compressed air or oil, is admitted into the cylinder 141 into the region or chamber 150 at the right-hand end of the piston as viewed in FIGS. 1, 2 and 3.

The pressure of the fluid exerts force on the piston 148 in a left-hand direction and on the cylinder 141 in a right-hand direction. The fluid pressure in the cylinder provides a substantially constant force transmitted against the linkage, members and pivotal connections or joints of the oscillating mechanisms or systems hereinbefore described, the force preloading these components so that the joints or pivotal connections are in the same relative position throughout the range of travel of the oscillating mechanisms or systems.

In the embodiment illustrated, there is connected to the cylinder a tubular means or pipe 154 connected with a pressure gage 156 which is connected with an adjustable pressure regulator 158. The pressure regulator 158 is connected with a cutoff valve 159 which is connected by a pipe 160 with a supply of fluid under pressure, preferably compressed air. The opposite end of the cylinder 141 is provided with a vent tube 163.

Where compressed air or other gas is employed as the force exerted in the cylinder chamber 150, the tube 163 will vent any air or gas which may seep past the piston 148. If hydraulic fluid is utilized, the tube 163 may be a return tube to the reservoir of oil or other liquid to convey any leakage to the reservoir. The force exerted against the oscillating mechanisms or systems by the fluid actuated means 129 opposes the operation of the mechanisms.

Hence, the force exerted by the fluid pressure actuated means 128 must be low enough to allow proper action and motion of the mechanisms or systems components but yet great enough to overcome the inertial forces exerted by the mchanisms or systems oscillating components. The adjustable pressure regulator 158 provides adjustment or control of the pressure so that accumulated tolerance or lost motion in the several joints or connections is eliminated without interferring with the proper oscillatory movements of the several components of the oscillating systems or mechanisms.

FIG. 3 illustrates schematically three sets of pull wheels 30 and 31 and oscillating linkage mechanisms associated with each set of pull wheels exemplifying that several fiber-attenuating dual pull wheel units may be utilized.

As will be seen from FIG. 2, there is a force exerting means 129 provided for the linkage associated with each pair of pull wheels 30 and 31. It is to be understood that additional pairs of fiber-forming and attenuating units may be utilized, a force producing means 129 being provided for each pair of units for eliminating the adverse effects of operating tolerances and clearances at the pivotal connections or joints of the oscillating systems or mechanisms. Through the method of the invention, the substantially constant force provided by each of the units 129 effects a preloading of the joints or connections so as to substantially eliminate lost motion in the operation of the oscillating systems or mechanisms.

Figure 4:
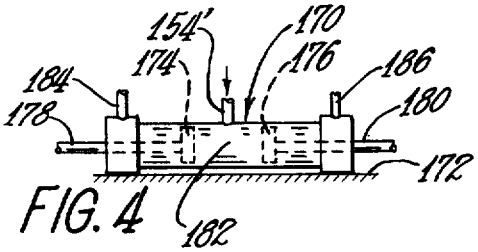
FIG. 4 is an elevational view of a modified form of force applying means for the oscillating system or mechanism.

FIG. 4 illustrates a modified form of force establishing means for eliminating the adverse effect of tolerances at the pivotal connections or joints in the oscillating mechanisms or systems. In this form the fluid pressure force producing means includes a cylinder 170 preferably fixedly mounted upon a support 172. Reciprocably disposed within the cylinder are pistons 174 and 176. The piston 174 is mounted on a rod 178, the latter adapted to be connected with a number 134' shown in FIGS. 1, 2 and 3.

The piston 176 is mounted on a rod 180 adapted to be connected with the member 134 shown in FIGS. 1, 2 and 3. Compressed air or other fluid under pressure is delivered by a pipe 154' to the chamber or region 182 in the cylinder between the pistons 174 and 176. The pipe 154' is connected with a supply of compressed air or other fluid under pressure. A pressure gage 156, an adjustable pressure regulator 158 and a cutoff valve 159, shown in FIG. 1, are associated with the pressure fluid conveying tube 154' for controlling the fluid pressure in the region 182 between the pistons 174 and 176.

The end heads of the cylinder 170 are respectively provided with tubes 184 and 186 to vent any seepage of fluid past the pistons. If compressed air o other compressed gas is used as a force producing media, the tubes 184 and 186 may vent any seepage of gas past the pistons to the atmosphere. If the pressure fluid employed is a liquid, such as oil, the tubes 184 and 186 may be utilized to return any seepage of liquid past the pistons to a reservoir. The fluid pressure in the region 182 between the pistons exerts force against each piston 174 and 176 and thus a substantially constant force is effective against each of the oscillating systems or mechanisms 62 and 64.

It is apparent that, within the scope of the invention, modifications and different arrangements may be made other than as herein disclosed, and the present disclosure is illustrative merely, the invention comprehending all variation thereof.

I claim:

1. The method of distributing a linear group of fibers onto a moving collector including engaging the group of fibers with a rotating pull wheel, disengaging the group of ffibers from the rotating pull wheel by an oscillating and rotating member associated with the pull wheel, oscillating the member by a cam-actuated linkage system to effect distribution of the group of fibers onto an area of the collector, and applying pressure on the linkage system opposing the operation of the linkage system to substantially eliminate lost motion in the linkage system and thereby promote oscillatory motion accuracy of the fiber disengaging member.

2. The method of processing fibers formed from streams of fiber-forming material flowing from a feeder including engaging the fibers with a rotating pull wheel for attenuating the streams of fibers, rotating a member relative to the pull wheel for disengaging the fibers from the pull wheel, oscillating the member by cam-actuated interconnected linkage, controlling the region of disengagement of the fibers from the pull wheel by the member through the oscillating linkage to effect distribution of the fibers on a collector, and applying fluid pressure on the linkage opposing the operation of the linkage to substantially eliminate lost motion at the linkage interconnections and thereby promote motion accuracy of the fiber disengaging member.

3. The method of processing fibers formed from streams of heat-softened glass including a first fiber-forming and distributing station having a rotating pull wheel for attenuating streams of glass to fibers, a second fiber-forming and distributing station having a rotating pull wheel for attenuating streams of glass to fibers, rotating a member associated with each of the pull wheels for disengaging the fibers from the pull wheels, oscillating the members by cam-actuated linkage systems individual to each member for controlling the region of disengagement of the fibers from each attenuating pull wheel to effect distribution of the fibers onto a moving collector, and applying fluid pressure on the linkage systems opposing the operation of the systems to substantially eliminate lost motion in the systems and thereby promote motion accuracy of the fiber disengaging members.

4. Apparatus of the character disclosed including, in combination, feeder means for flowing streams of heat-softened fiber-forming material, a rotatable pull wheel, means for rotating the pull wheel engaged with the fibers for attenuating the streams to fibers, a rotatable and oscillatable element associated with the fiber attenuating pull wheel for discharging the fibers from the pull wheel, a relatively movable collector arranged to receive fibers discharged from the rotating pull wheel, said element effecting discharge of the fibers from the rotating pull wheel in directions distributing the fibers over an area of the collector, and oscillating system comprising articulately interconnected linkage for imparting oscillatory movements to said element, rotatable cam means, a cam follower actuated by said cam means for effecting oscillation of said oscillating system, and means exerting pressure on the oscillating system opposing the operation of the system to eliminate lost motion at the articularly connections of the linkage of the oscillating system to promote motion accuracy of said fiber disengaging element associated with the pull wheel.

5. Apparatus of the character disclosed including, in combination, feeder means for flowing groups of streams of filament-forming material, a first filament-attenuating station including a first rotatable filament-attenuating pull wheel, a second filament-attenuating station including a second rotatable filament-attenuating pull wheel, said pull wheels adapted to attenuate the groups of streams from the feeder means into continuous filaments, a relatively movable filament collecting surface, a rotatable element adapted for oscillatory movement associated with each of the pull wheels for disengaging the filaments from the pull wheels whereby the filaments are projected transversely of the collecting surface, a first oscillating linkage mechanism for oscillating the element at the first station, a second oscillating linkage mechanism for oscillating the element at the second station, cam means for concomitantly actuating the oscillating linkage mechanisms to effect oscillatory movements of the elements at each of the station, and means applying pressure on each of the oscillating mechanism opposing the operation of he mechanisms to eliminate lost motion in the oscillating mechansims and promote motion accuracy of each of said fiber disengaging elements.

6. The combination according to claim 5 wherein the means applying pressure on the oscillating linkage mechanisms is fluid pressure operated.

7. Apparatus of the character disclosed, in combination, feeder means for flowing groups of streams of heat-softened glass, a first attenuating station including a rotatable pull wheel for attenuating a first group of streams of molten glass into continuous filaments, a second attenuating station including a second rotatable pull wheel for attenuating a second group of streams of molten glass into continuous filaments, a relatively movable collector adapted to receive the continuous filaments, a rotatable and oscillatable element associated with each pull wheel for disengaging the filaments from the peripheries of the pull wheel whereby the filaments are distributed onto the collector, a first oscillating mechanism comprising articulately interconnected linkage for transmitting motion to the element at the first attenuating station, a second oscillating mechanism comprising articulately interconnected linkage for transmitting motion to the element at the second attenuating station, rotatable cam means, cam followers actuated by said cam means for concomitantly actuating the oscillating mechanisms to impart oscillatory movements to the filament discharging element associated with the pull wheels, and fluid pressure actuated means exerting force on the oscillating mechanisms opposing the operation of the mechanisms to substantially eliminate lost motion at the articulate connections of the linkage of each of said oscillating mechanisms to promote motion accuracy to the filament disengaging elements associated with the pull wheels.

* * * * *